US008991728B2

(12) United States Patent
Weis et al.

(10) Patent No.: US 8,991,728 B2
(45) Date of Patent: Mar. 31, 2015

(54) PLUMBING OUTLET FIXTURE

(75) Inventors: Christoph Weis, Mullheim (DE); Hermann Grether, Mullheim (DE)

(73) Assignee: Neoperl GmbH, Mullheim (DE)

( * ) Notice: Subject to any disclaimer, the term of this patent is extended or adjusted under 35 U.S.C. 154(b) by 894 days.

(21) Appl. No.: 12/032,150

(22) Filed: Feb. 15, 2008

(65) Prior Publication Data

US 2008/0149743 A1 Jun. 26, 2008

Related U.S. Application Data

(62) Division of application No. 10/529,968, filed as application No. PCT/EP03/08842 on Aug. 8, 2003.

(30) Foreign Application Priority Data

Oct. 22, 2002 (DE) ..... 102 49 340
Nov. 5, 2002 (DE) ..... 202 17 031 U

(51) Int. Cl.
*E03C 1/08* (2006.01)
*B05B 1/28* (2006.01)
*E03C 1/086* (2006.01)

(52) U.S. Cl.
CPC ..... *E03C 1/086* (2013.01)
USPC ..... 239/428.5; 239/288.5

(58) Field of Classification Search
USPC ..... 239/428.5, 288–288.5
See application file for complete search history.

(56) References Cited

U.S. PATENT DOCUMENTS 3,223,045 A 12/1965 Shope
3,291,064 A 12/1966 Foster
3,635,405 A * 1/1972 Shames et al. ..... 239/428.5
3,684,191 A * 8/1972 Shames et al. ..... 239/428.5
4,320,541 A * 3/1982 Neenan ..... 4/492
4,365,755 A * 12/1982 Aghnides ..... 239/428.5
4,403,739 A * 9/1983 Knapp et al. ..... 239/428.5
4,470,546 A * 9/1984 Wildfang ..... 239/428.5
4,530,467 A * 7/1985 Bueno ..... 239/407
4,534,513 A * 8/1985 Aghnides ..... 239/428.5
4,534,514 A * 8/1985 Aghnides ..... 239/428.5
4,562,960 A * 1/1986 Marty et al. ..... 239/72

(Continued)

FOREIGN PATENT DOCUMENTS

CH 380 042 8/1964
DE 1 910 493 2/1965

(Continued)

*Primary Examiner* — Len Tran
*Assistant Examiner* — Steven M Cernoch
(74) *Attorney, Agent, or Firm* — Volpe and Koenig, P.C.

(57) ABSTRACT

A plumbing outlet armature (2) with a liquid guide (3), which opens into a fitting outlet (4) in an area in which a plumbing functional unit (5) in the form of an insertion cartridge is provided. The outlet fitting is provided such that the clear open cross-section of the liquid guide (3) is adapted to the insertion cartridge (5) at least in the opening area of the fitting outlet (4), and the insertion cartridge (5) can be inserted into the fitting outlet (4) from the opening side and is removably held therein. The inventive outlet armature is characterized by the insertion cartridge being removably held in the fitting outlet (4) by a sleeve-shaped intermediate holder (6), which intermediate holder itself is removably held in the fitting outlet (4) by a screw or bayonet connection. The inventive outlet fitting (2) can be used with a jet regulator or with another plumbing functional unit (5) without any significant limitations of the structural clearance.

7 Claims, 3 Drawing Sheets

(56) References Cited

U.S. PATENT DOCUMENTS

| | | | | | |
|---|---|---|---|---|---|
| 4,722,509 | A | | 2/1988 | Delker et al. | |
| 4,941,492 | A | * | 7/1990 | Morgan | 134/182 |
| 5,071,071 | A | * | 12/1991 | Chao | 239/428.5 |
| 5,467,929 | A | * | 11/1995 | Bosio | 239/428.5 |
| 5,495,985 | A | * | 3/1996 | Nehm et al. | 239/428.5 |
| 5,769,326 | A | * | 6/1998 | Muchenberger et al. | 239/428.5 |
| 5,803,368 | A | * | 9/1998 | Shekalim | 239/428.5 |
| 5,943,711 | A | * | 8/1999 | Loizeaux et al. | 4/541.6 |
| 6,029,912 | A | * | 2/2000 | Woolley | 239/428.5 |
| 6,126,093 | A | * | 10/2000 | Grether et al. | 239/428.5 |
| 6,152,182 | A | * | 11/2000 | Grether et al. | 138/42 |
| 6,249,921 | B1 | * | 6/2001 | Daniel et al. | 4/420.4 |
| 6,409,100 | B1 | * | 6/2002 | Lundberg | 239/428.5 |
| 6,513,731 | B2 | * | 2/2003 | Griffin et al. | 239/394 |
| 2002/0079471 | A1 | | 6/2002 | Shen | |
| 2002/0084353 | A1 | * | 7/2002 | Griffin et al. | 239/428.5 |

FOREIGN PATENT DOCUMENTS

| | | |
|---|---|---|
| DE | 35 09 666 | 9/1986 |
| DE | 38 35 143 | 4/1990 |
| DE | 40 39 337 | 7/1991 |
| DE | 198 05 691 | 8/1999 |
| DE | 198 51 151 | 5/2000 |
| FR | 2 576 939 | 8/1986 |

* cited by examiner

PLUMBING OUTLET FIXTURE

CROSS-REFERENCE TO RELATED APPLICATIONS

This application is a divisional of U.S. application Ser. No. 10/529,968, filed Mar. 31, 2005, which is incorporated herein by reference as if fully set forth.

BACKGROUND

The present invention relates to a sanitary outflow armature having a liquid guide that opens into a fitting outlet, in the area of which a plumbing functional unit in the form of an insertion cartridge is provided, wherein the clear cross-section of the opening of the liquid guide being adapted to the insertion cartridge at least in the opening area of the fitting outlet, and the insertion cartridge being capable of being inserted into the fitting outlet from the opening side and being held removably therein.

Various jet regulators have been created that are provided as plumbing functional units in the area of the fitting outlet of a sanitary outflow armature, and that are used to produce a soft, non-spraying jet of water. The known jet regulators can regularly be inserted into a sleeve-shaped outlet nozzle that can be screwed onto the end of the fitting outlet.

However, the use of a sleeve-shaped outlet nozzle that is to be screwed onto the fitting outlet requires an expensive machining of the outlet fitting, and, in addition, limits the structural clearance in the design of such an outlet fitting. In addition, the outlet nozzle, manufactured as a separate metal collar, usually chromed, results in significant additional costs.

In particular in high-quality fittings, which must also satisfy high aesthetic demands, the fitting and the associated nozzle must be jointly ground, polished, and subsequently chromed or painted together, at high expense, in order to achieve the smoothest possible transition between the fitting and the nozzle without color deviations and without disturbing gaps, and in order to ensure that the diameter is identical. The gaps that are standard with the use of conventional nozzles between the fitting and the nozzle that screws onto the outlet end of the fitting can not only disturb the optical appearance of such a fitting, but can also form a flaw from a hygienic point of view due to the collection of dirt.

SUMMARY

Therefore, the object arises in particular of creating a sanitary outflow armature that can be used with a jet regulator or with another plumbing functional unit without essential limitation of the structural clearance.

The solution according to the present invention is in particular that the insertion cartridge is held via an intermediate holder in the fitting outlet, which intermediate holder itself is removably held in the fitting outlet through a screw or bayonet connection.

The functional unit, in the form of an insertion cartridge, can be inserted into the fitting outlet from the opening side and is held therein in removable fashion. For the acceptance of this insertion cartridge, the inner diameter of the liquid guide of the outlet fitting is adapted to the insertion cartridge at least in the area of the opening of the fitting outlet. Thus, an outlet nozzle, and its additional significant costs, can be omitted; up to now, such nozzles have been associated with an overly high portion of the overall costs of an outlet fitting. Because the screwing on of such an outlet nozzle can be omitted, and because such an outlet nozzle also does not have to be processed together with the outlet fitting for color matching, the manufacture of the sanitary outflow armature is simplified significantly. Because a nozzle can be omitted, the gap that is typically present between the nozzle and the outlet fitting when conventional nozzles are used, and that has a disturbing optical effect and conflicts with desirable hygienic goals, can be avoided. The plumbing functional unit is held removably in the fitting outlet of the sanitary outflow armature, and can thus easily be detached and removed even by unskilled users for service work, such as for example the removal of dirt or for decalcification. The omission of an outlet nozzle also increases the structural clearance in the design of an outlet fitting, so that for example it is also possible to use colored outlet fittings without having to manufacture special nozzles having the corresponding color, at additional cost. The insertion cartridge is held in the fitting outlet by means of a preferably sleeve-shaped intermediate holder. Here, the insertion cartridge holding intermediate holder is seated in the fitting outlet and removably held there through a screw or bayonet connection.

It is useful if the insertion cartridge is situated in the fitting outlet with at least the predominant part of its longitudinal extension, preferably with its complete longitudinal extension. If the insertion cartridge is situated in the fitting outlet with its entire longitudinal extension, it can be housed in the fitting outlet so as to be hidden, i.e., practically invisible from the outside, and secure against manipulation. From there, the insertion cartridge can be detached for example with the aid of a crown key or an open wrench, or some other removal tool.

In order to facilitate the installation of the insertion cartridge in the fitting outlet and to determine the position of the insertion cartridge there, it is useful if the insertion cartridge or the intermediate holder can be inserted into the fitting outlet up to an insertion stop.

It is advantageous if the intermediate holder is sealed against the inner peripheral wall of the fitting outlet, preferably around the complete periphery. The sealing of the intermediate holder in the outlet fitting can take place by means of additional seals, such as for example an O-ring or a flat seal, seals formed onto the intermediate holder, or with the aid of connecting means, for example the adhesive means used in the gluing of the intermediate holder.

It is advantageous if the insertion cartridge is held in the fitting outlet or in the intermediate holder by means of a clamp connection, a locking connection, or a screw connection. Thus, the insertion cartridge can for example be held in the outlet fitting or the intermediate holder by a one-threaded or multi-threaded screw connection, or by snap connections; removable connections of this sort enable a rapid and simple assembly and disassembly of the functional unit as needed.

It is useful if the insertion cartridge is also sealed against the intermediate holder or against the inner peripheral wall of the fitting outlet. Such a sealing of the functional unit against the intermediate holder or against the inner peripheral wall of the fitting outlet can for example take place by means of an O-ring, a flat seal, or other known seals.

A preferred specific embodiment according to the present invention provides that at least one annular seal, preferably at least one O-ring, is provided for the sealing between the intermediate holder on the one hand and the outlet fitting on the other hand.

According to a further development of the present invention, it is provided that the intermediate holder bears an outer thread that can be screwed into an inner threading in the fitting outlet, and that the outer thread and the inner thread are dimensioned and situated such that when the intermediate holder is screwed in, the threads grasp one another in a relative position of the outlet fitting on the one hand and the intermediate holder on the other hand in which the O-ring, or similar annular seal, provided on the outer periphery of the intermediate holder does not yet make frictional contact with the outlet fitting. Through the situation of the annular seal, which seals radially in the fitting housing, during assembly and disassembly a clear advantage can be made use of: during assembly, there is a significantly greater feeling for finding the threads, because the annular seal is not pressed radially until the thread has already been found. The pressing of the annular seal produces a large amount of friction, which would otherwise make the feeling for the assembly significantly more difficult. During disassembly, the selected situation of the annular seal has the advantage that the insertion cartridge is rotated out of the screwed connection with the fitting outlet with the aid of the insertion and removal tool. As long as the annular seal is still in the pressed state, there is a forced axial movement through the threading. The threading does not come out of engagement until the annular seal has left the fitting seat in the axial direction. This has the decisive advantage that the functional unit, constructed as a hidden insertion cartridge assembled with an intermediate holder, can be removed from the fitting completely by rotational movement, without requiring either additional axial drawing due to the influence of friction or the support of water pressure.

However, it is also possible for at least one peripheral seal to be formed in one piece onto the insertion cartridge; here, in the sealing region the insertion cartridge can be constructed not only as a multi-component injection-molded part, but in particular also as a single-component injection-molded part.

A particularly advantageous development according to the present invention, warranting separate protection, therefore provides that the insertion cartridge and/or the intermediate holder are connected in one piece with at least one peripheral seal between the insertion cartridge and/or the intermediate holder on the one hand and the outlet fitting on the other hand. The one-piece formed-on seal, provided on the insertion cartridge and/or on the intermediate holder, prevents creeping or leakage currents of the liquid, etc., flowing through the outlet fitting between the insertion cartridge and/or the intermediate holder on the one hand and the outlet fitting on the other hand.

A preferred development according to the present invention provides that the plumbing functional unit is fashioned as a jet regulator.

BRIEF DESCRIPTION OF THE DRAWINGS

Additional features of the present invention result from the following description of exemplary embodiments according to the present invention, in connection with the claims and the drawings. The individual features can be realized individually or in combination in a specific embodiment according to the present invention.

Shown are.

DETAILED DESCRIPTION OF THE PREFERRED EMBODIMENTS

Figure 1:
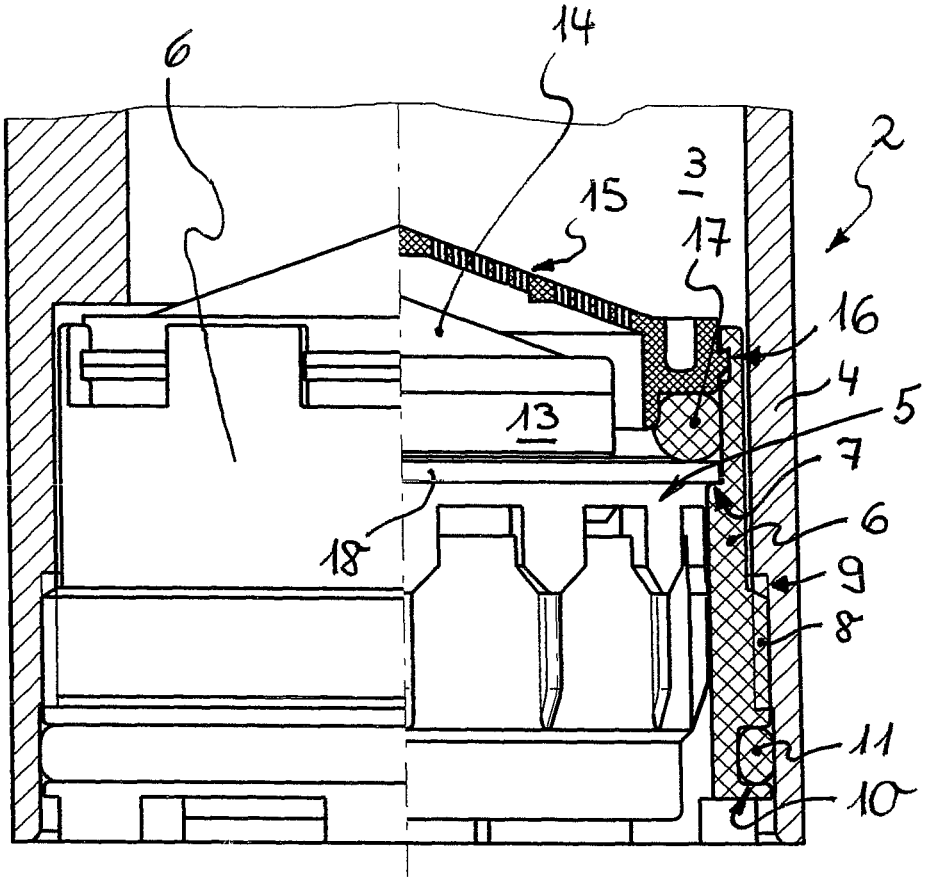
FIG. 1 is a view of a sanitary outflow armature in whose fitting outlet a plumbing functional unit in the form of an insertion cartridge is held in removable fashion by an intermediate holder.
Figure 3:
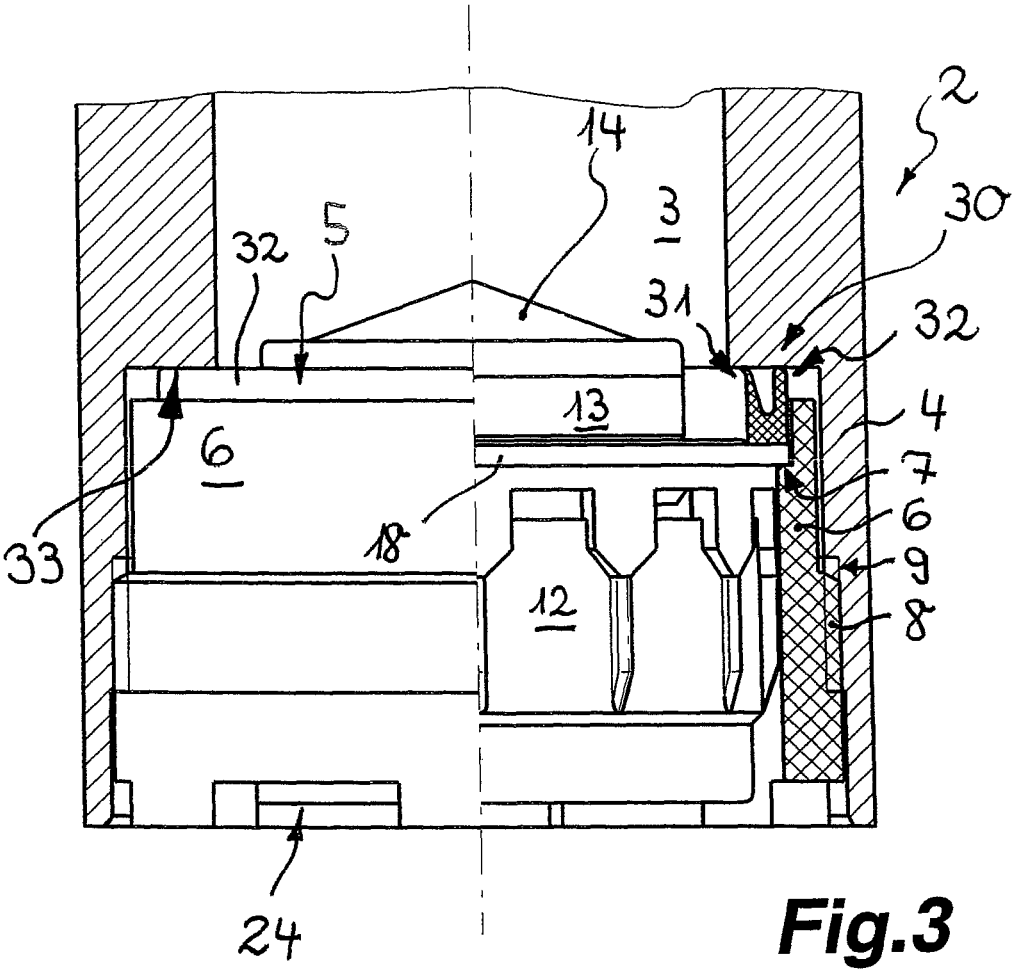
FIG. 3 is a view of a sanitary outflow armature in whose fitting outlet an insertion cartridge comparable to that shown in FIG. 1 can be removably placed by means of an intermediate holder, such that at the flow inlet side of this insertion cartridge a peripheral seal is formed on in one-piece fashion in order to provide a seal between the insertion cartridge and the intermediate holder on the one hand and the outlet fitting on the other hand.

In FIGS. 1 and 3, a sanitary outflow armature 2 is shown. The outlet armature 2 has a liquid guide 3 that opens into an outlet fitting 4. In the area of this outlet fitting 4, a plumbing functional unit 5 is provided that acts here as a jet regulator. The functional unit 5, acting as a jet regulator, is fashioned as an insertion cartridge in whose interior at least a jet fractionating device and a jet regulating device are provided.

From FIGS. 1 and 3, it can be seen that the insertion cartridge 5 can be inserted into the fitting outlet 4 from the opening side of the outlet armature 2 and is held removably therein, and that the insertion cartridge 5 is here situated completely and with its entire longitudinal extension in the fitting outlet 4 so as to be practically invisible.

The insertion cartridge 5 of the outlet armature 2 shown in FIGS. 1 and 3 is held immediately in the fitting outlet 4 by a sleeve-shaped or cup-shaped intermediate holder 6.

This intermediate holder 6 can be fastened removably or non-removably in the fitting outlet 4. The insertion cartridge 5 is also fastened removably in the intermediate holder 6 in the outlet fitting 2, so that the user can easily remove it from the outlet fitting 2 as needed, for example for service work for the removal of dirt or for decalcification.

The outlet fitting 2 shown here can be manufactured without a great outlay and at relatively low cost. An additional cost reduction is achieved in that the outlet nozzles previously required are omitted.

The sealing of the intermediate holder 6 in the fitting outlet 4 can for example be accomplished with additional seals, such as an O-ring or a flat seal, with seals sprayed onto intermediate holder 6.

In FIG. 1, the sanitary outflow armature 2 is shown in the area of the fitting outlet 4 of its liquid guide 3. In the area of the fitting outlet 4, a plumbing functional unit, in the form of an insertion cartridge 5, is provided that is held in the fitting outlet 4 via a sleeve-shaped intermediate holder 6. The insertion cartridge 5 can be placed into the intermediate holder 6 from the flow inlet side of the intermediate holder 6, up to a holding projection 7. The intermediate holder 6 has on its peripheral edge area at the flow outlet side an outer threading 8 that can be screwed into a complementary inner threading in the fitting outlet 4 in such a way that the intermediate holder 6, and the insertion cartridge 5 situated therein, are situated completely in the fitting outlet 4 with their entire longitudinal extension.

At the side facing away from the direction of flow of the outer threading 8, on the periphery of the intermediate holder, an annular seal 11, held in an annular groove 10, is provided that provides a seal in the radial direction between the intermediate holder 6 and the inner periphery of outlet fitting 1. Here, the insertion cartridge 5 is formed from a jet regulator 12 at the flow outlet side, that is connected, preferably in removable fashion, at the flow inlet side with a flow regulator 13 as well as with a sieve attachment 14 that is connected upstream.

At the flow inlet side of the intermediate holder 6, an additional sieve attachment 15 is provided that can extend over a comparatively large cross-section inside liquid guide 3 of the outlet fitting 2. The sieve attachment 15 is connected in removable fashion with the intermediate holder 6, and has for this purpose a peripheral locking projection 16 on its peripheral edge that engages in an annular groove on the inner periphery at the flow inlet side of the intermediate holder 6. Between the sieve attachment 15 and an end surface at the flow inlet side of the jet regulator 12 of the insertion cartridge 5, an annular seal 17 that seals in the axial direction is provided; the jet regulator 12 is held between a holding projection 7 and the sieve attachment 15 with an annular flange 18. Functional units of standard construction, such as for example a jet regulator, flow regulator, backflow prevention device, and/or sieve attachment, can be inserted into the intermediate holder 6.

While the left half of the longitudinal section shown in FIG. 1 shows the installation of the insertion cartridges in an outlet fitting constructed as a molded part, in the right half of FIG. 1 it is shown that the insertion cartridges can also be installed into an outlet fitting constructed at the opening side as a metal tube.

In FIG. 1, it is indicated that the intermediate holder 6 has an end surface at the flow outlet side that is contoured and is formed from projections and recesses 24, this contouring being constructed as a tool engagement surface, for example for a complementarily shaped insertion tool. A standard coin piece can possibly also be used here as an insertion tool.

Figure 2:
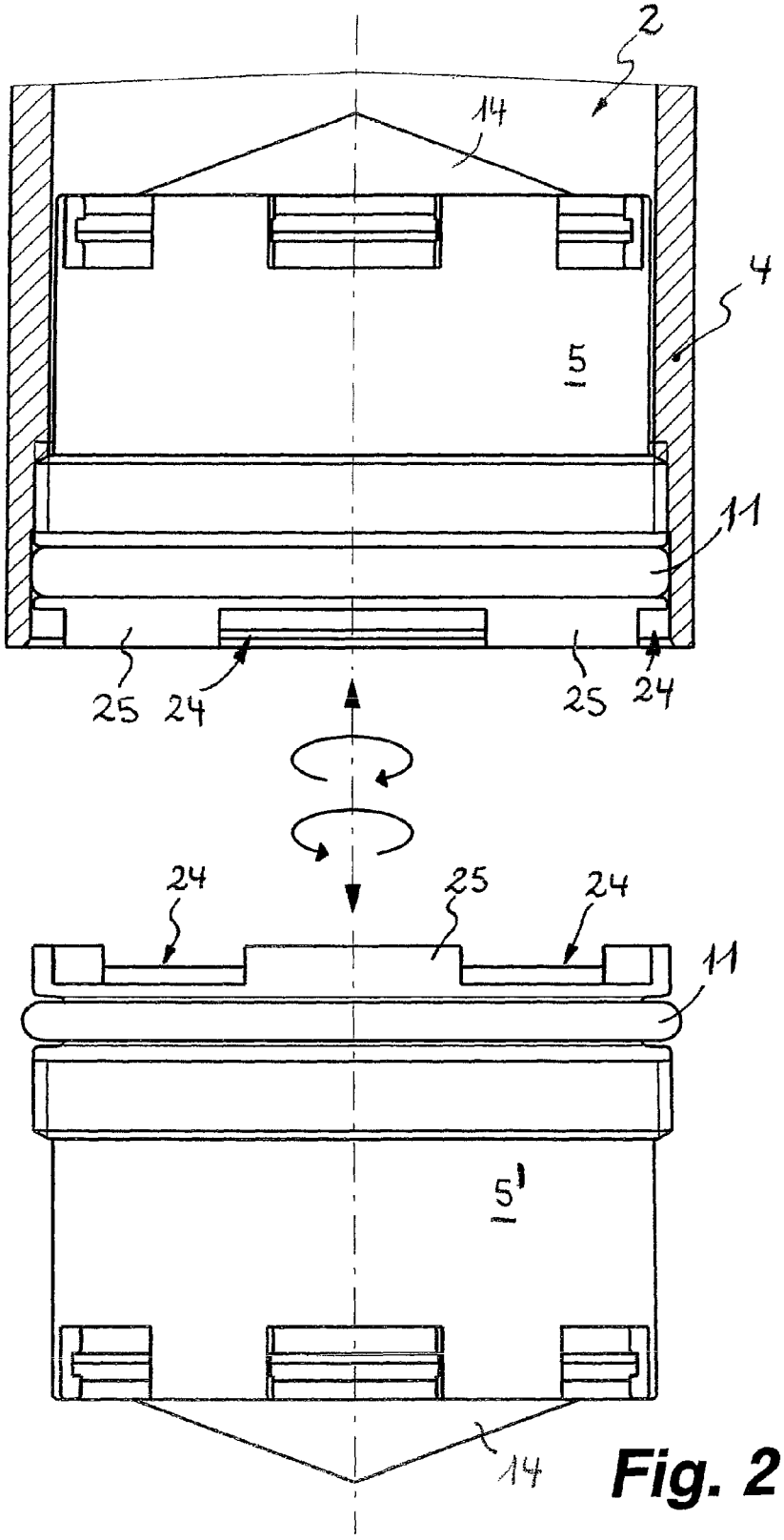
FIG. 2 is a view of a sanitary outflow armature having an insertion cartridge that can be placed into the fitting outlet, in which, for the screwing of the insertion cartridge in and out of the fitting outlet, an identically constructed additional insertion cartridge, provided for the exchange, can be used.

In FIG. 2, a complete insertion cartridge 5' is used to exchange the insertion cartridge 5 situated in the outlet fitting 1. It is also possible to use only an additional intermediate holder 6, or only an additional cartridge housing of an insertion cartridge that is otherwise not provided, to unscrew the insertion cartridge 5 situated in the outlet fitting or to unscrew the intermediate holder 6. For this purpose, the manufacturer of the fittings may supply only an additional intermediate holder or only an additional cartridge housing with the fitting, intended for use as an insertion tool. This has the advantage that the fitting manufacturer need not supply a second functional unit that can be installed in the outlet fitting, and the additional intermediate holder or the additional cartridge housing, manufactured and used in relatively large piece numbers, represents a very economical auxiliary tool.

FIG. 3 shows an outlet fitting 2 into which an insertion cartridge 5 comparable to that shown in FIG. 1 can be placed using an intermediate holder 6. While an annular seal 11 constructed as an O-ring is provided on the intermediate holder 6 shown in FIG. 3, on the insertion cartridge 5 shown in FIG. 1, instead of this, a seal 30 is formed on in one-piece fashion at the flow inlet side. The seal 30, formed on in one piece at the inflow-side final edge area of the cartridge housing, is formed as a sealing profile that has a sealing lip 31 as well as a peripheral external insertion stop 32 situated parallel to the sealing lip. In the position of use of the insertion cartridge 5, the insertion stop 32 limits a deformation of the seal 30 and of its sealing profile. In the position of use, the sealing profile with the sealing lip 31 and its insertion stop 32 work together with an annular projection 33 situated around the inner periphery of the fitting outlet, which limits the clear outlet cross-section of outlet fitting 2. The cartridge housing of the insertion cartridge 5, with the seal 30 formed thereon in one piece, can be manufactured as a single-component or multi-component injection-molded part. For the simple recycling of the materials used for the insertion cartridge and its intermediate holder, it is however useful if the cartridge housing and the seal 30 formed thereon are made of the same, preferably food-safe, material. In this way, the manufacturing outlay is simplified and the tool costs for an injection-molding tool that may be required can be kept relatively low.

As can be seen by comparing FIGS. 1 and 3, the insertion cartridge 5 shown in FIG. 3 is significantly easier to construct, because the additional sieve attachment 15, fashioned in FIG. 3 as a snap ring at the flow inlet side, and annular seals 11 and 17, can be omitted, which is significantly simpler from the point of view of assembly and manufacture.

The plumbing functional units shown here can be inserted into the outlet end of a sanitary outflow armature 2 in such a way that a nozzle that can be screwed onto the outlet end from the outside can be omitted. Because in the outlet fittings shown here a nozzle can be omitted, the gap is also omitted that would otherwise remain between the nozzle and the outlet fitting; this gap would have an adverse effect on the optical appearance of such an outlet fitting and would work against hygienic requirements due to the accumulation of dirt. Because, in the outlet fitting 2 shown here, the insertion cartridge is situated with its entire longitudinal extension completely in the liquid guide of the outlet fitting, the outlet fitting can be given a uniform coloring or chroming without a great expense, without simultaneously also having to give a nozzle or other components the same color or shape. Because the entire inner diameter of the liquid guide provided in the outlet fitting is available for the insertion cartridge, large-surface sieve attachments can also be used, which significantly prolong the useful time between two maintenance intervals. If the insertion cartridge, as shown in FIG. 2, is constructed at its flow outlet side in such a way that an insertion cartridge having an identical construction but intended for exchange can be screwed on and off it, the insertion cartridge can simultaneously also act as a tool for assembly and disassembly.

The invention claimed is:

1. Sanitary outflow armature (2) comprising a liquid guide (3) that opens into a fitting outlet (4), in an area of which a plumbing functional unit is provided, the plumbing functional unit (5) is an insertion cartridge and comprises:

a. a jet regulator (12), b. a tube-shaped intermediate holder (6), having an open first upstream end and an open second downstream end, adapted to receive the jet regulator (12) at the first end; the tube-shaped intermediate holder comprising a contoured outer periphery defining a tool engagement surface at the second end, for an insertion/removal tool, and c. a sealing element (11), wherein the insertion cartridge is inserted directly into the outlet from an outflow portion thereof and is held removably therein via the tube-shaped intermediate holder (6) via a threaded or bayonet connection.

2. The outlet fitting of claim 1, wherein the jet regulator (12) is held in the tube-shaped intermediate holder (6) by a clamped, sealed, locking or screw connection.

3. The outlet fitting of claim 1, wherein the jet regulator (12) and the tube-shaped intermediate holder (6) are connected in one piece.

4. The outlet fitting of claim 1, wherein the jet regulator (12) comprises a housing, a mixing chamber located therein, a jet fractioning device, having a plurality of openings upstream of the mixing chamber and a jet rectifier at an outlet portion thereof.

5. The outlet fitting of claim 1, wherein the tool engagement surface and the tool have a generally identical profile.

6. The outlet fitting of claim 1, wherein the tool engagement surface has a pattern of depressions or projections.

7. A plumbing functional unit (5) embodied as an insertion cartridge insertable in a fitting outlet of a sanitary outflow armature, the functional unit comprising:

a. a jet regulator (12);

b. a tube-shaped intermediate holder (6), having an open first upstream end and an open second downstream end, adapted to receive the jet regulator (12) at the first end, the tube-shaped intermediate holder comprising a contoured outer periphery defining a tool engagement surface for an insertion/removal tool at the second end; and c. a sealing element (11), wherein the insertion cartridge is adapted to be directly inserted into the outlet from an outflow portion thereof and is held removably therein via the tube-shaped intermediate holder (6) via a threaded or a bayonet connection.

* * * * *